US007350358B2

(12) United States Patent
Patel et al.

(10) Patent No.: US 7,350,358 B2
(45) Date of Patent: Apr. 1, 2008

(54) EXIT DUCT OF ANNULAR REVERSE FLOW COMBUSTOR AND METHOD OF MAKING THE SAME

(75) Inventors: Bhawan Bhal Patel, Mississauga (CA); Lorin Markarian, Etobicoke (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 428 days.

(21) Appl. No.: 10/988,568

(22) Filed: Nov. 16, 2004

(65) Prior Publication Data

US 2006/0101828 A1 May 18, 2006

(51) Int. Cl.
*F02C 1/00* (2006.01)
*F02G 3/00* (2006.01)

(52) U.S. Cl. ..... 60/760

(58) Field of Classification Search ..... 60/752–760
See application file for complete search history.

(56) References Cited

U.S. PATENT DOCUMENTS 3,186,168 A 6/1965 Ormerod et al.
3,670,497 A 6/1972 Sheldon
3,691,766 A * 9/1972 Champion ..... 60/39.826
3,738,106 A * 6/1973 Stein et al. ..... 60/39.23
3,844,116 A * 10/1974 Matto ..... 60/800
3,965,066 A 6/1976 Sterman et al.
4,195,476 A * 4/1980 Wood ..... 60/737
4,203,283 A * 5/1980 Weiler ..... 60/804
4,439,982 A * 4/1984 Weiler et al. ..... 60/805
4,549,402 A * 10/1985 Saintsbury et al. ..... 60/738
4,725,199 A 2/1988 Johnson
5,237,813 A * 8/1993 Harris et al. ..... 60/804
5,265,412 A 11/1993 Bagepalli et al.
5,329,761 A 7/1994 Ablett et al.
5,400,586 A 3/1995 Bagepalli et al.
5,417,545 A 5/1995 Harrogate
5,628,193 A * 5/1997 Kington et al. ..... 60/752
6,079,199 A * 6/2000 McCaldon et al. ..... 60/800
6,269,628 B1 * 8/2001 Gates ..... 60/804
6,495,207 B1 * 12/2002 Prociw et al. ..... 427/245
6,536,201 B2 * 3/2003 Stuttaford et al. ..... 60/782
6,596,122 B1 7/2003 Savitski et al.
6,810,672 B2 * 11/2004 Coutandin ..... 60/752
6,925,810 B2 * 8/2005 Swaffar ..... 60/752
6,955,053 B1 * 10/2005 Chen et al. ..... 60/804
7,000,406 B2 * 2/2006 Markarian et al. ..... 60/796
2002/0162331 A1 * 11/2002 Coutandin ..... 60/752
2005/0120718 A1 * 6/2005 Markarian et al. ..... 60/800
2005/0229604 A1 * 10/2005 Chen ..... 60/776
2006/0042257 A1 * 3/2006 Stastny ..... 60/772
2006/0042271 A1 * 3/2006 Morenko et al. ..... 60/804
2006/0053797 A1 * 3/2006 Stastny et al. ..... 60/772

* cited by examiner

*Primary Examiner*—William H. Rodriguez
(74) *Attorney, Agent, or Firm*—Ogilvy Renault LLP

(57) ABSTRACT

A gas turbine engine comprising an annular reverse-flow combustor having a sheet metal combustor wall between a long exit duct portion and a small exit duct portion of the combustor. An exit duct portion of the combustor forms a sliding joint with a downstream turbine vane assembly and has at least two discrete sheet metal walls fastened to the sheet metal combustor wall at a common intersection region.

15 Claims, 2 Drawing Sheets

EXIT DUCT OF ANNULAR REVERSE FLOW COMBUSTOR AND METHOD OF MAKING THE SAME

TECHNICAL FIELD

The invention relates generally to a gas turbine engine combustor, and, more particularly, to a low cost combustor construction.

BACKGROUND OF THE ART

Exit ducts of annular reverse flow combustors configured for sliding engagement with a downstream turbine vane ring, such that at least axial relative movement therebetween is possible, are typically expensive to manufacture. Constructing the combustor walls and exit duct section using sheet metal reduces the material cost, however the manufacture of such a sliding-type joint made of sheet metal nonetheless involves several time consuming, and therefore costly, manufacturing operations. As opportunities for reducing cost and improving cost effectiveness are continuously sought, there remains a need for an improved combustor construction to further reduce manufacturing cost.

SUMMARY OF THE INVENTION

It is therefore an object of this invention to provide an improved gas turbine combustor construction and process for manufacturing same.

In a first aspect, the present invention provides an annular reverse-flow combustor for a gas turbine engine comprising: an outer combustor liner; an inner sheet metal combustor liner; and a small exit duct disposed at an exit of the combustor and being fastenable to the inner sheet metal combustor liner, the small exit duct having first and second sheet metal walls radially spaced from each other at downstream ends thereof such that the small exit duct is adapted to form a sliding-type joint with an outer platform of a turbine vane assembly disposed downstream from the exit of the combustor, wherein the first and second sheet metal walls of the small exit duct and the inner sheet metal combustor liner are independently formed and fastened together along a common annular intersection region.

In a second aspect, the present invention provides a gas turbine engine comprising an annular reverse-flow combustor having a sheet metal combustor wall and a combustor exit defined between a long exit duct portion and a small exit duct portion of the combustor, at least one of the small exit duct portion and the long exit duct portion being adapted for forming a sliding joint with a downstream turbine vane assembly and having at least two discrete sheet metal walls fastened to the sheet metal combustor wall at a common intersection region.

In a third aspect, the present invention provides a gas turbine engine comprising an annular reverse-flow combustor having a sheet metal combustor wall and a combustor exit defined between a long exit duct portion and a small exit duct portion of the combustor, at least one of the small exit duct portion and the long exit duct portion being adapted for forming a sliding joint with a downstream turbine vane assembly and having at least two discrete sheet metal walls fastened to the sheet metal combustor wall at a common intersection region.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
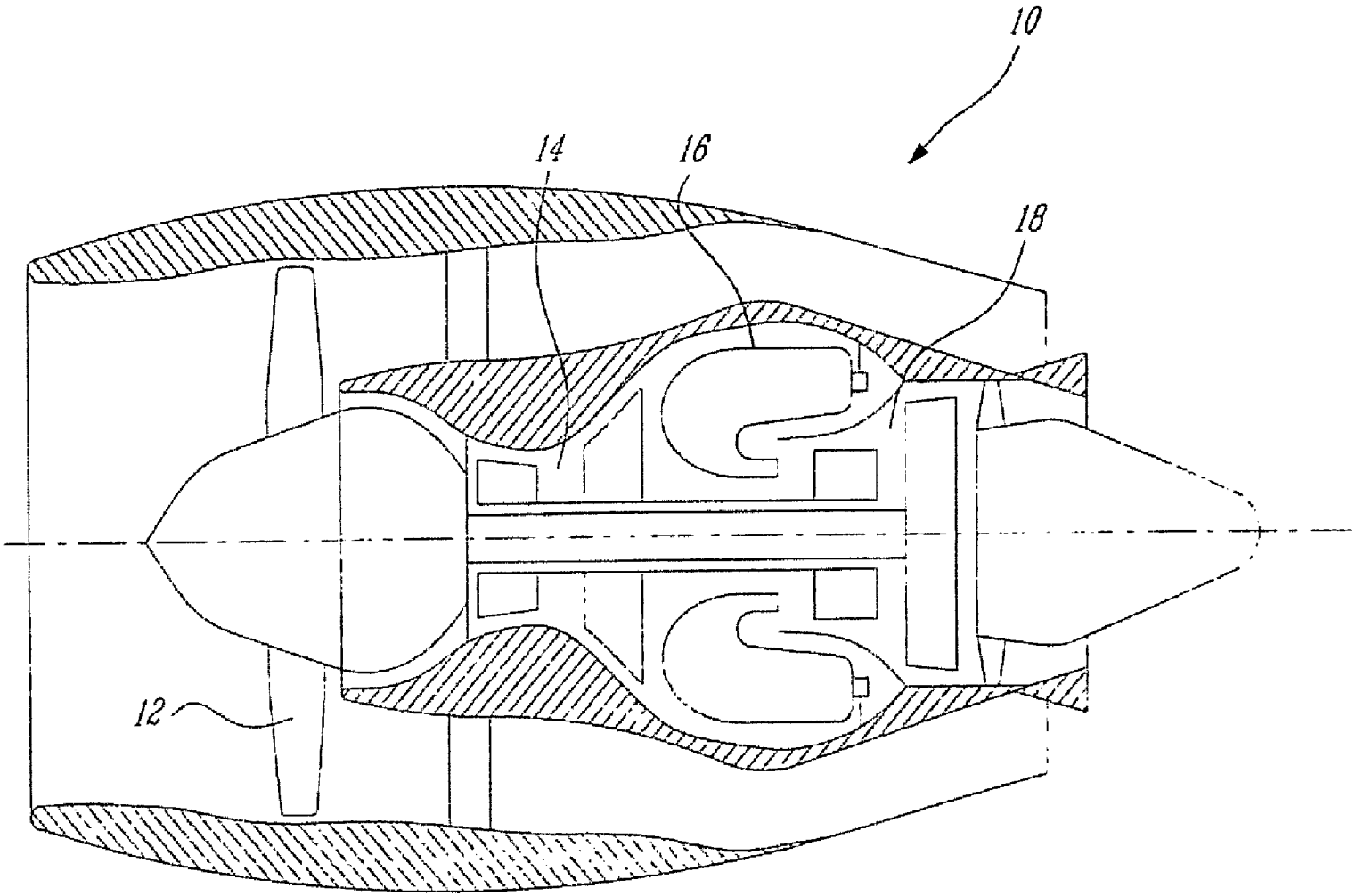
FIG. 1 shows a schematic cross-section of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, an annular reverse flow combustor 16 in which the compressed air is mixed with fuel and ignited for generating an annular stream of hot combustion gases, and a turbine section 18 for extracting energy from the combustion gases.

Figure 2:
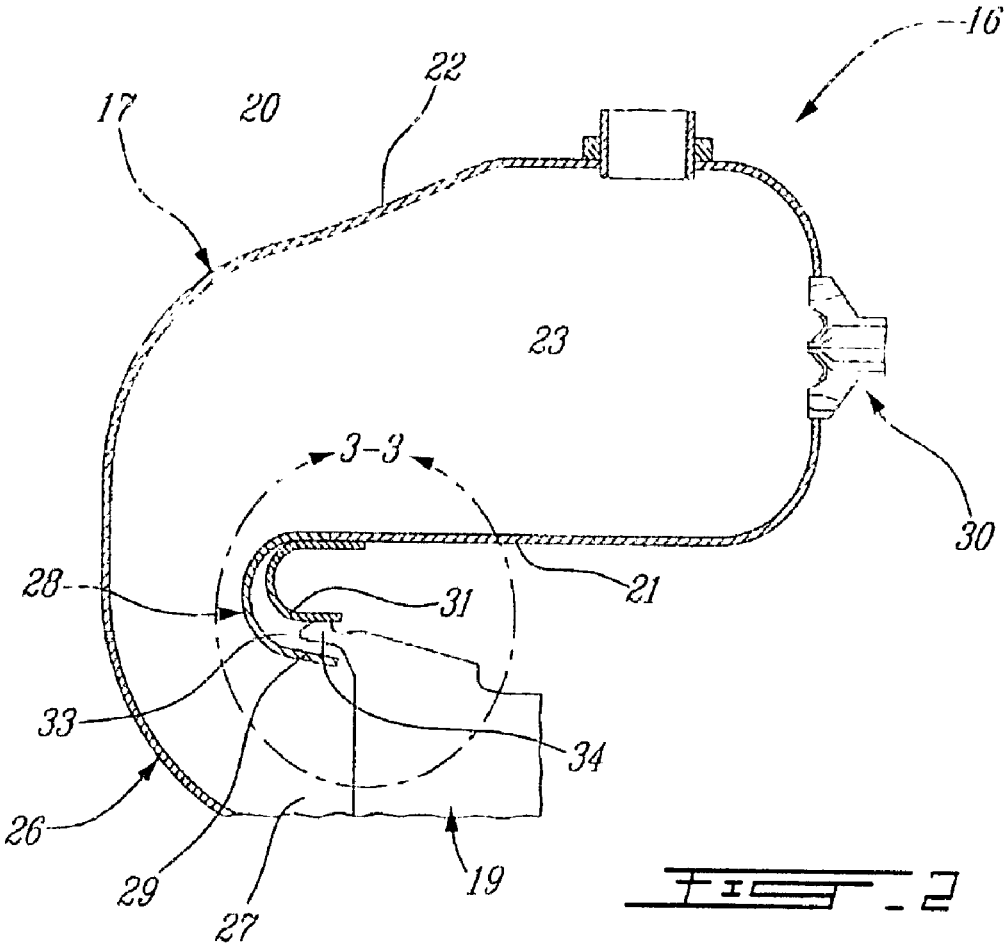
FIG. 2 shows a partial cross-section of an annular reverse flow combustor having a small exit duct portion in accordance with the present invention.

Referring to FIG. 2, the annular reverse flow combustor 16 comprises generally a combustor liner 17, having an inner liner portion 21 and an outer liner portion 22 defining a combustion chamber 23 therebetween. The inner and outer liners portions 21 and 22 of the combustor liner 17 are preferably provided by a single ply of sheet metal. Outer liner 22 includes a long exit duct portion 26, while inner liner 21 includes a small exit duct portion 28, both leading to a combustor exit 27 in fluid flow communication with a downstream turbine stage. At least one fuel nozzle 30 communicates with the combustion chamber 23 to inject fuel therein. An air plenum 20, which surrounds the combustor liner 17, receives compressed air from the compressor section 14 of the gas turbine engine 10. In use, compressed air from plenum 20 enters combustion chamber through a plurality of holes (not shown) defined through the combustor liner and is ignited and fuelled by fuel injected into the combustion chamber 23 by nozzles 30. Hot combusted gases within the combustion chamber 23 are directed through the reverse flow combustor, which redirects the flow aft towards an annular vane ring 19 of the high pressure turbine stage downstream of the combustor exit 27.

The small exit duct 28 of the combustor 16 is comprised of sheet metal, and forms a sliding-type joint with the outer vane platform 34 of the vane ring 19, such that relative movement therebetween is possible in at least an axial direction to accommodate for thermal growth differential therebetween. To create such a sliding joint, the small exit duct 28 is formed having annular, and preferably concentric, inner and outer wall sections 29 and 31 respectively. The inner wall section 29 and the outer wall section 31 of the small exit duct 28 being radially spaced apart at downstream ends thereof by a annular gap 33 defined therebetween, within which the axially projecting outer vane platform 34 of the vane ring 19 is received. Preferably, as is depicted, the outer vane platform 34 abuts the outer wall section 31 to form a seal therewith.

Figure 3:
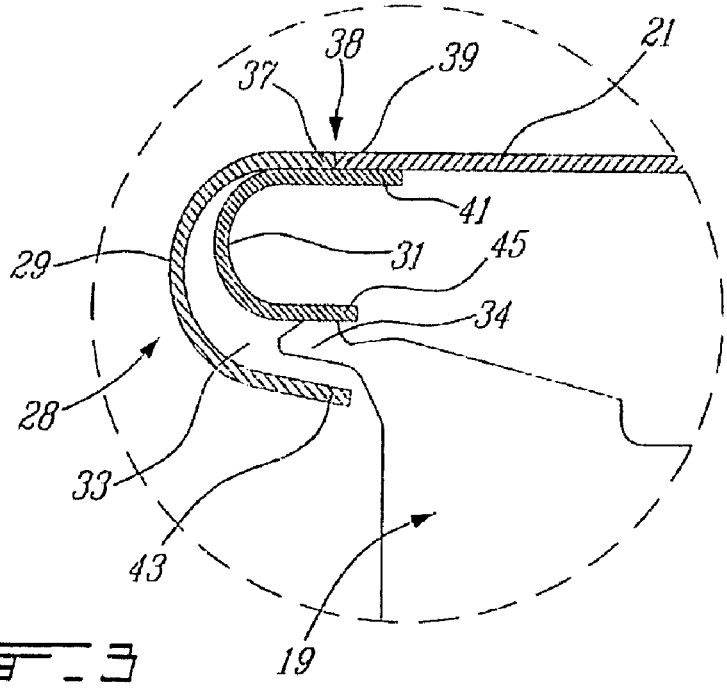
FIG. 3 is a detailed partial cross-sectional view taken from region 3 of FIG. 2, showing the small exit duct portion of the present invention.

As best seen in FIG. 3, the small exit duct 28 therefore comprises the inner and outer sheet metal wall sections 29 and.31, which are radially spaced apart at their respective downstream ends 43 and 45 to define the annular gap 33 therebetween, and which are fastened together at respective upstream ends 37 and 41 thereof to the inner liner portion 21 of the combustor. Both the inner wall section 29 and the outer wall section 31 are composed of single-ply sheet metal, and each formed having a substantially U-shaped cross-sectional shape. The outer wall section 31 is formed having a U-shaped cross-sectional area with a smaller radius of curvature than that of the inner wall section 29, which also has a slightly wider open end of the U-shaped configuration defined between the upstream end 37 and the downstream end 43. Thus, the annular outer wall section 31 can be nested within the annular inner wall section 31. Both the inner wall section 29 and the outer wall section 31 of the small exit duct 28 are annular components which extend circumferentially about the combustor exit 27. The three sheet metal portions, namely the inner and outer small exit duct wall sections 29 and 31 and the sheet metal combustor inner liner 21, are then all fastened together at a common intersection region 38. As depicted, an upstream end 37 of the inner wall section 29 abuts a downstream end 39 of the inner combustor liner 21 end-to-end to form a butt joint therebetween, and an upstream end 41 of the outer wall section 31 overlays the butt-joint, thereby forming a lap-joint thereover. Preferably, these three sheet metal portions are joined together simultaneously in a single step by a single attachment means, such as by an annular weld provided through the sheet metal at the common intersection region/joint 38 between the three sheet metal sections. This accordingly forms a welded butt joint and a lap joint in a single operation at the intersection region 38 to fasten the three sheet metal sections 29, 31 and 21 together. Any suitable type of welding can be employed to create such a joint between the three sheet metal sections. The three sheet metal sections are thus independently formed and assembled such that they can be fastened together at a single common intersection region 38 by a suitable attachment means.

Thus, the relatively complex form of the sheet metal small exit duct 28 configured to create a sliding joint with the outer vane platform 34 of the vane ring 19 is easily produced in a cost effective manner. Particularly, a simple yet strong joint is provided with sheet metal elements, independently formed and joined together by an attachment means in a single manufacturing operation.

The above description is meant to be exemplary only, and one skilled in the art will recognize that changes may be made to the embodiments described without department from the scope of the invention disclosed. For example, although described and depicted relative to a small exit duct portion of a sheet metal combustor, the invention is similarly applicable to the long exit duct portion engaged in a sliding joint arrangement with an inner vane platform of the high pressure turbine vane ring. Additionally, alternate means of fastening, other than welding, may also be used to fix the three independently formed sheet metal sections 29, 31 and 21 together, such as by bonding or fastening using mechanical fasteners for example. Still other modifications which fall within the scope of the present invention will be apparent to those skilled in the art, in light of a review of this disclosure, and such modifications are intended to fall within the appended claims.

The invention claimed is:

1. An annular reverse-flow combustor for a gas turbine engine comprising:

an outer combustor liner;

an inner sheet metal combustor liner; and an exit duct portion disposed at an exit of the combustor and being fastened to the inner sheet metal combustor liner, the exit duct portion having first and second sheet metal walls radially spaced from each other at downstream ends thereof such that the exit duct portion is adapted to form a sliding-type joint with an outer platform of a turbine vane assembly disposed downstream from the exit of the combustor, wherein the first and second sheet metal walls of the exit duct portion and the inner sheet metal combustor liner are independently formed and fastened together along a common annular interface, and wherein a single attachment fastens the first and second sheet metal walls and the inner sheet metal combustor liner together at said common annular interface.

2. The combustor as defined in claim 1, wherein the attachment means is an annular weld.

3. The combustor as defined in claim 2, wherein the annular weld is continuous and performed in a single manufacturing operation.

4. The combustor as defined in claim 1, wherein the common annular interface is defined by one of the first and second sheet metal walls abutted end-to-end to the inner sheet metal combustor liner to define an annular joint therebetwcen, and the other of the first and second sheet metal walls overlaps the annular joint.

5. The combustor as defined in claim 4, wherein the first and second sheet metal walls and the inner sheet metal combustor liner are fastened together by a single weld about the annular joint.

6. The combustor as defined in claim 5, wherein the single weld comprises a butt and lap welded joint performed in a single operation.

7. A gas turbine engine comprising an annular reverse-flow combustor having a sheet metal combustor wall and a combustor exit defined between radially inner and outer exit duct portions of the combustor, the radially outer exit duct portion being fastened to an inner liner of the sheet metal combustor wall and being adapted for forming a sliding joint with a downstream turbine vane assembly, the radially outer exit duct portion having at least two discrete sheet metal walls fastened to the inner liner of the sheet metal combustor wall at a common interface, and wherein the two discrete sheet metal walls and the sheet metal combustor wall are fastened together about a single annular joint at the common interface, a single attachment fastening the two discrete sheet metal walls and the sheet metal combustor wall together.

8. The gas turbine engine as defined in claim 7, wherein the attachment means is an annular weld.

9. The gas turbine engine as defined in claim 8, wherein the annular weld is continuous and performed in a single manufacturing operation.

10. The gas turbine engine as defined in claim 7, wherein one of the two discrete sheet metal walls is abutted end-to-end to the sheet metal combustor wall to define an annular joint therebetween, and the other of the two discrete sheet metal walls overlaps the annular joint.

11. The gas turbine engine as defined in claim 10, wherein the two discrete sheet metal walls and the sheet metal combustor wall are fastened together by a single weld about the annular joint.

12. The gas turbine engine as defined in claim 11, wherein the single weld comprises a butt and lap welded joint.

13. A method of forming a gas turbine engine annular reverse flow combustor having a combustor liner, the method comprising forming at least an exit duct of the combustor out of sheet metal, including the steps of:

forming discrete first and second sheet metal wall portions of the exit duct;

abutting one of the first and second sheet metal wall portions to an end of the combustor liner, defining an annular joint therebetween;

overlaying the other of the first and second sheet metal wall portions over the annular joint on an outer side of the combustor, such that the first and second sheet metal wall portions and the combustor liner meet at the annular joint; and fastening the first and second sheet metal wall portions and the combustor liner together along the annular joint, including welding the first and second sheet metal wall portions and the inner combustor liner together at the annular joint.

14. The method as defined in claim 13, further comprising performing the welding about the annular joint in a single manufacturing operation.

15. The method as defined in claim 13, wherein the step of forming further comprises forming the discrete first and second sheet metal wall portions further into nestable annular components of the exit duct which each define a substantially U-shaped cross-sectional area.

* * * * *